US011761466B2

(12) United States Patent
Opperwall et al.

(10) Patent No.: US 11,761,466 B2
(45) Date of Patent: Sep. 19, 2023

(54) HYDRAULIC CONTROL SYSTEMS AND METHODS USING MULTI-FUNCTION DYNAMIC SCALING

(71) Applicant: HUSCO International, Inc., Waukesha, WI (US)

(72) Inventors: Timothy Opperwall, Waukesha, WI (US); Ben Holter, Waukesha, WI (US); Austin Sowinski, Waukesha, WI (US); Mike Fossell, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 301 days.

(21) Appl. No.: 17/293,858

(22) PCT Filed: Nov. 13, 2019

(86) PCT No.: PCT/US2019/061259
§ 371 (c)(1),
(2) Date: May 13, 2021

(87) PCT Pub. No.: WO2020/102408
PCT Pub. Date: May 22, 2020

(65) Prior Publication Data

US 2022/0010821 A1 Jan. 13, 2022

Related U.S. Application Data

(60) Provisional application No. 62/760,739, filed on Nov. 13, 2018, provisional application No. 62/760,843, filed on Nov. 13, 2018.

(51) Int. Cl.
*F15B 21/08* (2006.01)
*F15B 19/00* (2006.01)

(52) U.S. Cl.
CPC ..... *F15B 21/08* (2013.01); *F15B 19/002* (2013.01); *F15B 19/007* (2013.01);
(Continued)

(58) Field of Classification Search
CPC ..... F15B 2211/30525; F15B 19/002; F15B 21/08; F15B 2211/327; F15B 21/087
See application file for complete search history.

(56) References Cited

U.S. PATENT DOCUMENTS 5,873,244 A * 2/1999 Cobo ..... E02F 9/2228 60/452
6,305,162 B1 * 10/2001 Cobo ..... E02F 9/2221 60/431

(Continued)

*Primary Examiner* — Abiy Teka
(74) *Attorney, Agent, or Firm* — Quarles & Brady LLP

(57) ABSTRACT

Systems and methods for control of multi-function hydraulic commands of a multi-function electrohydraulic system are provided. In one aspect, a system for hydraulic control includes a first function in fluid communication with a first electrohydraulic control valve and a second function in fluid communication with a second electrohydraulic control valve. The system includes a controller in communication with the first electrohydraulic control valve and the second electrohydraulic control valve. The controller can be configured to receive an input target command, determine an achievable function rate based on the input target command, where the achievable function rate maintains a proportional relationship between the input target command and the achievable function rate. The controller can also map the achievable function rate to an output command based on a predetermined relationship between the achievable function rates and the output commands and supply the output command to the first and second electrohydraulic valves.

15 Claims, 7 Drawing Sheets

(52) U.S. Cl.
CPC ..... *F15B 2211/30525* (2013.01); *F15B 2211/327* (2013.01); *F15B 2211/351* (2013.01); *F15B 2211/6336* (2013.01); *F15B 2211/6346* (2013.01); *F15B 2211/6654* (2013.01)

(56) References Cited

U.S. PATENT DOCUMENTS

2005/0175485 A1* 8/2005 Udagawa ..... F15B 11/167
417/199.1
2005/0211312 A1* 9/2005 Pfaff ..... F15B 21/087
137/596.17

* cited by examiner

HYDRAULIC CONTROL SYSTEMS AND METHODS USING MULTI-FUNCTION DYNAMIC SCALING

CROSS-REFERENCES TO RELATED APPLICATIONS

The present application represents the U.S. national stage entry of International Application No. PCT/US2019/061259 filed Nov. 13, 2019, which is based on, claims priority to, and incorporates herein by reference in its entirety, U.S. Provisional Patent Application No. 62/760,843, filed on Nov. 13, 2018, and entitled "Hydraulic Control Systems and Methods Using Multi-Function Dynamic Scaling" and U.S. Provisional Patent Application No. 62/760,739, filed on Nov. 13, 2018, and entitled "Control Strategy for Hydraulic Systems."

STATEMENT REGARDING FEDERALLY SPONSORED RESEARCH

Not Applicable.

BACKGROUND

In some hydraulic systems, a function may be controlled via a lookup table or map, which includes data for operating, for example, an electrohydraulic control valve configured to influence a supply of fluid to the function.

BRIEF SUMMARY

The present disclosure provides a hydraulic control system that enables multi-function dynamic manipulation of performance maps based on function commands.

In one aspect, the present disclosure provides a hydraulic control system including at least a first function, a second function, a first electrohydraulic control valve in fluid communication with the first function, and a second electrohydraulic control valve in fluid communication with the second function. The hydraulic system can also include a controller in communication with the first electrohydraulic control valve and the second electrohydraulic control valve. The controller can be configured to receive an input target command including a first target rate of the first function and a second target rate of the second function. The controller may then determine an achievable rate based on the input target command, where the achievable rate includes a first achievable rate of the first function and a second achievable rate of the second function that are selected from a plurality of achievable function rates to maintain a proportional relationship between a target ratio of the first target rate to the second target rate and an achievable ratio of the first achievable rate to the second achievable rate. The controller may also be configured to map the achievable rate to an output command based on a predetermined relationship between the achievable rate and the output command, where the output command can include a first output command and a second output command. Finally, the controller can supply the first output command to the first electrohydraulic control valve and supply the second output command to the second electrohydraulic control valve.

In one aspect, the present disclosure provides a method of controlling one or more functions in a hydraulic system. The method can include receiving an input target command, including a first target rate of a first function and a second target rate of a second function. The method can also include determining an achievable rate based on the input target command, where the achievable rate includes a first achievable rate of the first function and a second achievable rate of the second function that can be selected from a plurality of achievable function rates to maintain a proportional relationship between a target ratio of the first target rate to the second target rate and an achievable ratio of the first achievable rate to the second achievable rate. The method can also include mapping the achievable rate to an output command based on a predetermined relationship between the achievable rate and the output command, where the output command includes a first output command and a second output command. Additionally, the method can include supplying the first output command to a first electrohydraulic control valve in communication with the first function and supplying the second output command to a second electrohydraulic control valve in communication with the second function.

In some aspects, the present disclosure provides a method of controlling one or more functions in a hydraulic system. The method can include receiving an input target command including a first target rate of a first function and a second target rate of a second function. Then, correlating the first target rate with a first output command to a first electrohydraulic control valve in fluid communication with the first function and correlating the second target rate with a second output command to a second electrohydraulic control valve in fluid communication with the second function, the first and second output commands being derived from a predefined data set that can map the input target commands to output commands based on an achievable performance of the first function and the second function. The method can also include determining which of the first function and the second function defines a slower dynamic response based on the first and second output commands. Upon determining that the first function defines the slower dynamic response, supplying the first output command to the first electrohydraulic control valve and supplying a transient command to the second electrohydraulic control valve, wherein the transient command can be configured to decrease a response performance of the second function relative to the second output command configured to reduce an error in controlling a rate of the first function and the second function.

In some aspects, the present disclosure provides a method of controlling one or more functions in a hydraulic system. The method can include receiving an input target command including a first target rate of a first function and a second target rate of a second function. The method can also include correlating the first target rate with a first output command to a first electrohydraulic control valve in fluid communication with the first function and correlating the second target rate with a second output command to a second electrohydraulic control valve in fluid communication with the second function. The first and second output commands can be derived from a predefined data set mapping the input target commands to output commands based on an achievable performance of the first function and the second function. The method can also include determining which of the first function and the second function defines a slower dynamic response based on the first and second output commands. Upon determining that the first function defines the slower dynamic response, supplying a modified output command to the first electrohydraulic control valve and supplying the second output command to the second electrohydraulic control valve, where the modified output command can be configured to increase a dynamic response performance of the first function.

In some aspects, the present disclosure provides a method of controlling one or more functions in a hydraulic system. The method can include receiving a first output command for a first electrohydraulic control valve in fluid communication with a first function and a second output command for a second electrohydraulic control valve in fluid communication with a second function. The method can include determining which of the first function and the second function defines a slower dynamic response based on the first and second output commands. Upon determining that the first function defines the slower dynamic response, supplying the first output command to the first electrohydraulic control valve and supplying a transient command to the second electrohydraulic control valve, wherein the transient command can be configured to decrease a response performance of the second function relative to the second output command to match a dynamic response of the first function and the second function. Alternatively or additionally, the method can further include determining that the first function defines the slower dynamic response, supplying a modified output command to the first electrohydraulic control valve and supplying the second output command to the second electrohydraulic control valve, wherein the modified output command can be configured to increase a dynamic response performance of the first function.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
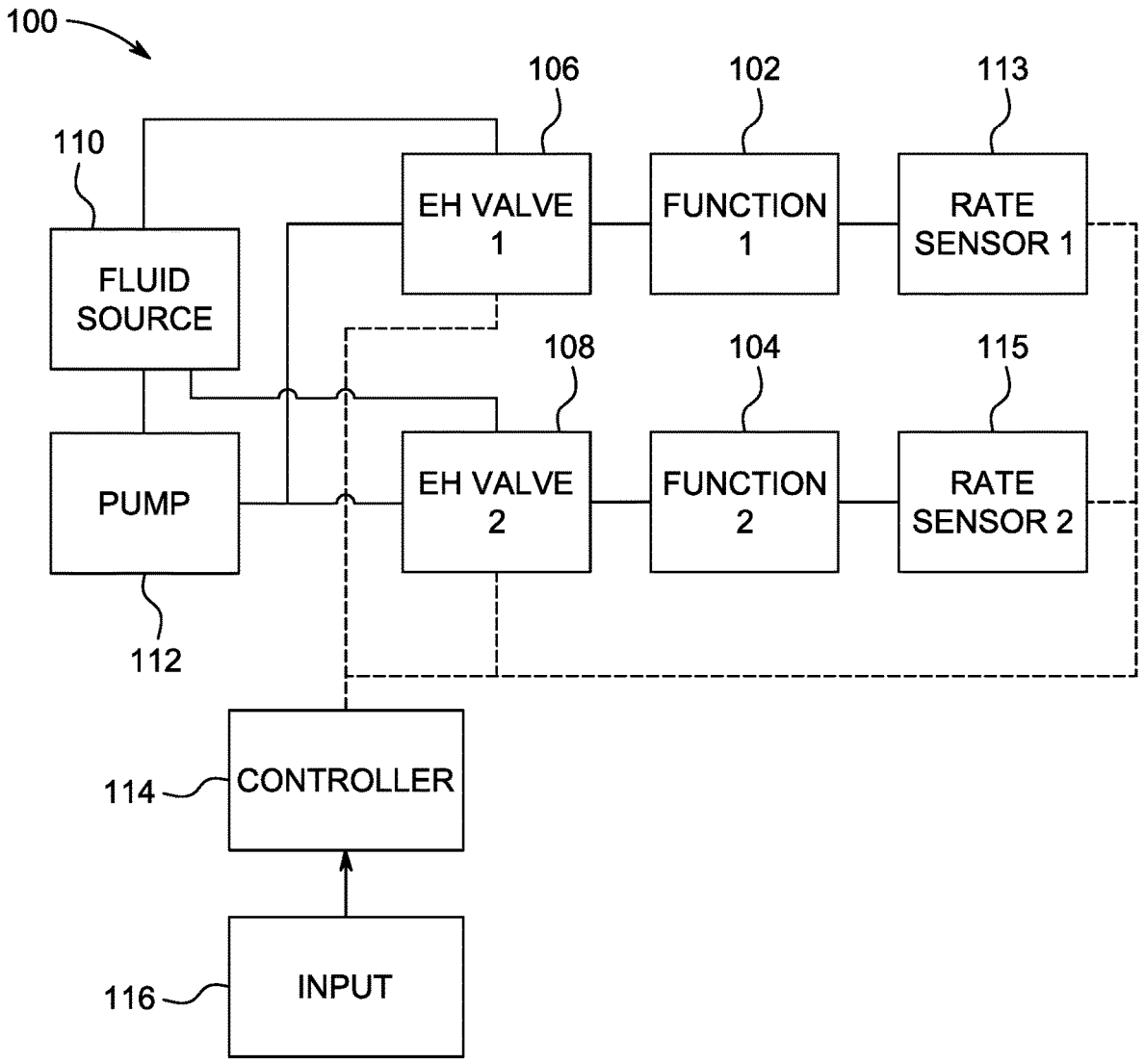
FIG. 1 is a schematic illustration of a hydraulic system including a controller according to one aspect of the present disclosure.

Before any aspects of the present disclosure are explained in detail, it is to be understood that the invention is not limited in its application to the details of construction and the arrangement of components set forth in the following description or illustrated in the following drawings. The invention is capable of other forms and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use aspects of the present disclosure. Various modifications to the illustrated forms will be readily apparent to those skilled in the art, and the generic principles herein can be applied to other aspects and applications without departing from aspects of the disclosure. Thus, aspects of the present disclosure are not intended to be limited to aspects shown, but are to be accorded the widest scope consistent with the principles and features disclosed herein. The following detailed description is to be read with reference to the figures, in which like elements in different figures have like reference numerals. The figures, which are not necessarily to scale, depict selected aspects and are not intended to limit the scope of the present disclosure. Skilled artisans will recognize the examples provided herein have many useful alternatives and fall within the scope of aspects of the invention.

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

The use of the term "rate" herein is a term that can correspond to a kinematic property of a structure. The term "rate" may correspond with one or more of a position, a velocity, and an acceleration of a structure (e.g., a hydraulic function or movable component of a mobile machine). The term "rate" may also correspond with one or more of a rate of a function, a flow rate, or a cylinder speed (e.g., flow rate, function velocity, mass or volumetric flow rate controlled by a function, etc.).

Generally, aspects of the present disclosure provide a controller for a multi-function hydraulic system that is configured to convert target rate commands for hydraulic functions (e.g., boom, arm, or bucket) into the maximum achievable commands. The conversion from the target rate command to the achievable command can include scaling the target rate command and preserving a proportionality therebetween.

FIG. 1 illustrates one non-limiting example of a hydraulic system 100 configured to control a multi-function mobile machine according to the present disclosure. In some non-limiting examples, the mobile machine may comprise an earth moving machine, such as an excavator, a dozer, a motor grader, a wheel loader, a scraper, or a skid steer, among other configurations. In some non-limiting examples, the hydraulic system 100 may be provided on a mobile machine that requires accurate positioning of a component, particularly during hydraulic function commands that require multiple functions to operate at the same time. In the some non-limiting examples, the hydraulic functions can be in the form of a hydraulic actuator. The systems and methods described herein may be applicable to other types of hydraulic functions that require accurate rate control. In some non-limiting examples, the hydraulic functions may be in the form of a motor, a jack, a linear actuator, or a rotary actuator.

In the illustrated non-limiting example, the hydraulic system 100 can be a multi-function system including at least two hydraulic functions. For example, the hydraulic system 100 can include a plurality of functions. In the illustrated non-limiting example, the hydraulic system 100 can include a first function 102 and a second function 104. The first function 102 and the second function 104 can be coupled to structural components of the mobile machine. In one non-limiting example, the hydraulic functions may be coupled to enable motion or positioning of a cab, boom, arm, stick, bucket, or tracks of a mobile machine. The hydraulic system 100 can further include a plurality of electrohydraulic valves, each corresponding to one of the plurality of functions. In the illustrated non-limiting example, the hydraulic system 100 can include a first electrohydraulic valve 106 and a second electrohydraulic valve 108. In one non-limiting example, the first electrohydraulic valve 106 and the second electrohydraulic valve 108 can include a spool that is proportionally movable between one or more end positions and any position between the end positions. For example, the first electrohydraulic valve 106 and the second electrohydraulic valve 108 may include a proportionally-operated solenoid coupled to the spool that is configured to move the spool to a predefined position in response to a command (e.g., a current magnitude) applied thereto.

The first electrohydraulic valve 106 can be in fluid communication with the first function 102 and the second electrohydraulic valve 108 can be in fluid communication with the second function 104. In the illustrated non-limiting example, the hydraulic system 100 can also include a fluid source 110 (e.g., a tank, a reservoir, and the like) in fluid communication with a pump 112. The fluid source 110 can be configured to supply fluid flow to the pump 112. The fluid source 110 can also be in fluid communication with the first electrohydraulic valve 106 and the second electrohydraulic valve 108. The pump 112 can be in fluid communication with the first electrohydraulic valve 106 and the second electrohydraulic valve 108 to provide pressurized fluid thereto.

The first electrohydraulic valve 106 can selectively control fluid communication between the first function 102 and both of the pump 112 and the fluid source 110. Similarly, the second electrohydraulic valve 108 can selectively control fluid communication between the second function 104 and both of the pump 112 and the fluid source 110. As such, the first electrohydraulic valve 106 and the second electrohydraulic valve 108 can be configured to control the motion of the first function 102 and the second function 104 in a first direction or a second direction (e.g., extend and retract). For example, the first electrohydraulic valve 106 may supply pressurized fluid from the pump 112 to one side of the first function 102 (e.g., a piston side, not shown) and connect the other side of the first function 102 (e.g., a rod side, not shown) to the fluid source 110, thereby causing the first function 102 to extend. Alternatively, the first electrohydraulic valve 106 may provide the opposite fluid connections (e.g., connect the piston side to the fluid source 110 and the rod side to the pump 112) to retract the first function 102. The second electrohydraulic valve 108 may independently perform the same operations on the second function 104.

In some non-limiting examples, a plurality of rate sensors may be configured to measure a rate of each of the plurality of hydraulic functions of the hydraulic system 100. In some non-limiting examples, the rate sensors may be configured to measure or calculate a position of the first function 102 and the second function 104, from which velocity and acceleration may be derived. In some non-limiting examples, the rate sensors may be coupled to component on the mobile machine (e.g., a bucket) that is geometrically linked to the hydraulic function. A known geometric relationship may be leveraged to determine a position of one or more functions on the mobile machine. For example, the rate sensor can be configured to measure the speed of a tip of a bucket that a function is controlling. In this non-limiting example, the speed of the tip of the bucket can be affected by commanding movement of the structures of the mobile machine, such as the boom, arm, or bucket. In some non-limiting examples, the rate sensors may be an inertial measurement unit configured to determine a change in rate (e.g., acceleration) from which velocity and position may be derived. In some non-limiting examples, the rate sensors may be a gyroscope sensor configured to determine a change in orientation. In some non-limiting examples, the rate sensors may be a GPS configured to determine global position. In some non-limiting examples, the rate sensors may be an LVDT configured to determine a position. In some non-limiting examples the rate sensors can be a string potentiometer or a position encoder configured to determine a position. In some non-limiting examples, the rate sensors can be a laser or optical sensor. In other non-limiting examples, the rate sensor can be a microwave motion sensor. In some non-limiting examples, the rate sensor can be a time-of-flight sensor. In some non-limiting examples, the rate sensor can sense a relative velocity. For example, the rate sensor can be configured to measure a velocity of a structure or component of the mobile machine relative to a speed or position of the mobile machine (e.g., relative to the ground or the direction of gravity).

In some non-limiting examples, the rate sensors may be configured to measure a rate of rotation of the structural elements of the mobile machine. For example, in the non-limiting case of an excavator, the rate sensors can be configured such that a rate of rotation (e.g., a rotational position, speed, or acceleration) can be calculated. In one non-limiting example, the rate sensors can be configured such that a relative rate of rotation can be determined between the tracks or base and a cab of a mobile machine. In one non-limiting example, the rate sensors can be configured such that a relative rate of rotation can be determined between the cab and a boom of the mobile machine. In another non-limiting example, the rate sensors can be configured such that a relative rate of rotation can be determined between the boom and a stick (e.g., arm) of the mobile machine. In one non-limiting example, the rate sensors can be configured such that a relative rate of rotation can be determined between the stick and a bucket. In some non-limiting examples, the rate sensors may be configured to measure a function rate (e.g., cylinder speed). In some non-limiting examples, the rate sensors may be flow meters configured to measure a mass or volumetric flow rate of fluid controlled by a function. The measured mass or volumetric flow rate of the functions measured by the flow meters can then be correlated to a function rate or structure rate of motion.

In the illustrated non-limiting example, the first function 102 may be in communication with a first rate sensor 113 and the second function 104 may be in communication with a second rate sensor 115. One of ordinary skill in the art may recognize that other methods may be possible for determining relative motion rates (e.g., linear or rotational) between hydraulic functions or structural elements of the mobile machine, which may be moved directly or indirectly by the hydraulic functions. For example, via relative motion calculations between structural elements of a mobile machine.

In the illustrated non-limiting example, the hydraulic system 100 can include a controller 114. The controller 114 can be in electrical communication with the first electrohydraulic valve 106, the second electrohydraulic valve 108, the first rate sensor 113, and the second rate sensor 115. The controller 114 may be configured to send control signals to the first electrohydraulic valve 106 and the second electrohydraulic valve 108 and receive signals (e.g., feedback signals) from the first rate sensor 113, the second rate sensor 115, and various other sensors installed within the hydraulic system 100 (e.g., pressure sensors, etc.). In one non-limiting example, the controller 114 can send command signals (e.g., to vary a supplied electrical current) to the first electrohydraulic valve 106 and the second electrohydraulic valve 108 to position a spool received therein, thereby actuating the first function 102 and the second function 104 in a desired direction at a desired speed (i.e., with a desired rate).

In the illustrated non-limiting example, the controller 114 can be configured to receive an input 116. In one non-limiting example, the input 116 may be in the form of a position of a control stick given by an operator within the cabin. For example, the operator of the mobile machine can input a multi-function command using controls within the cabin. The controls can be in electrical communication with the controller 114 such that the multi-function command given by the operator can be received by the controller 114 as an input signal. In one non-limiting example, the input 116 can be in the form of a command signal generated by an autonomous mobile machine vehicle controller (not shown). For example, the autonomous mobile machine can have a predefined set of commands to execute, or may use machine learning methods to achieve a predefined desired result (e.g., surface grade, work or plow area, path, etc.). In one non-limiting example, the autonomous mobile machine controller may determine, or be given an as an input, a desired machine component (e.g., bucket, plow, etc.) travel path. For example, the travel path for the machine component can define a plow area, desired grade of an excavation, or a volume or hole in the ground to be excavated. The autonomous mobile machine controller may then determine a plurality of commands (e.g., target commands or target function rates, as will be described herein) required to provide the desired machine component travel path and provide the plurality of commands as an input to controller 114. In one non-limiting example, the input 116 can be issued to the controller 114 via a remote operator. For example, the remote operator can have a remote (not shown) in communication (e.g., wired or wireless) with the mobile machine. The remote operator can use controls on the remote to provide multi-function commands to the controller 114.

Figure 2:
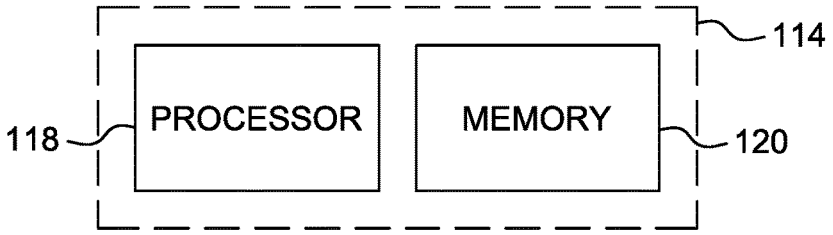
FIG. 2 is a schematic illustration of the hydraulic controller of FIG. 1.

Referring now to FIG. 2, the controller 114 may be a microcomputer-based device that includes a processor 118, which executes instructions of a control program or calibration program, to be described herein, and memory 120 for storing the executable instructions and data (e.g., multi-function control maps) for the control program. In some non-limiting examples, the memory 120 may store a lookup table or a multi-function control map. In some non-limiting examples, the multi-function control map can be a pilot pressure/velocity (PV) spool map, a current/velocity map, and/or an input command/velocity map. The foregoing control maps may be derived from a calibration procedure or algorithm based on executable instructions stored on the memory 120 and carried out by the processor 118 on the controller 114. In one non-limiting example, the controller 114 may use the multi-function control maps to control and adjust commands or inputs to the first electrohydraulic valve 106 and the second electrohydraulic valve 108 based on data therein. For example, a command mapping procedure or algorithm, described herein, can be defined such that multi-function commands given to the controller 114 can be adjusted such that an output command is mapped from a target input command.

Figure 3:
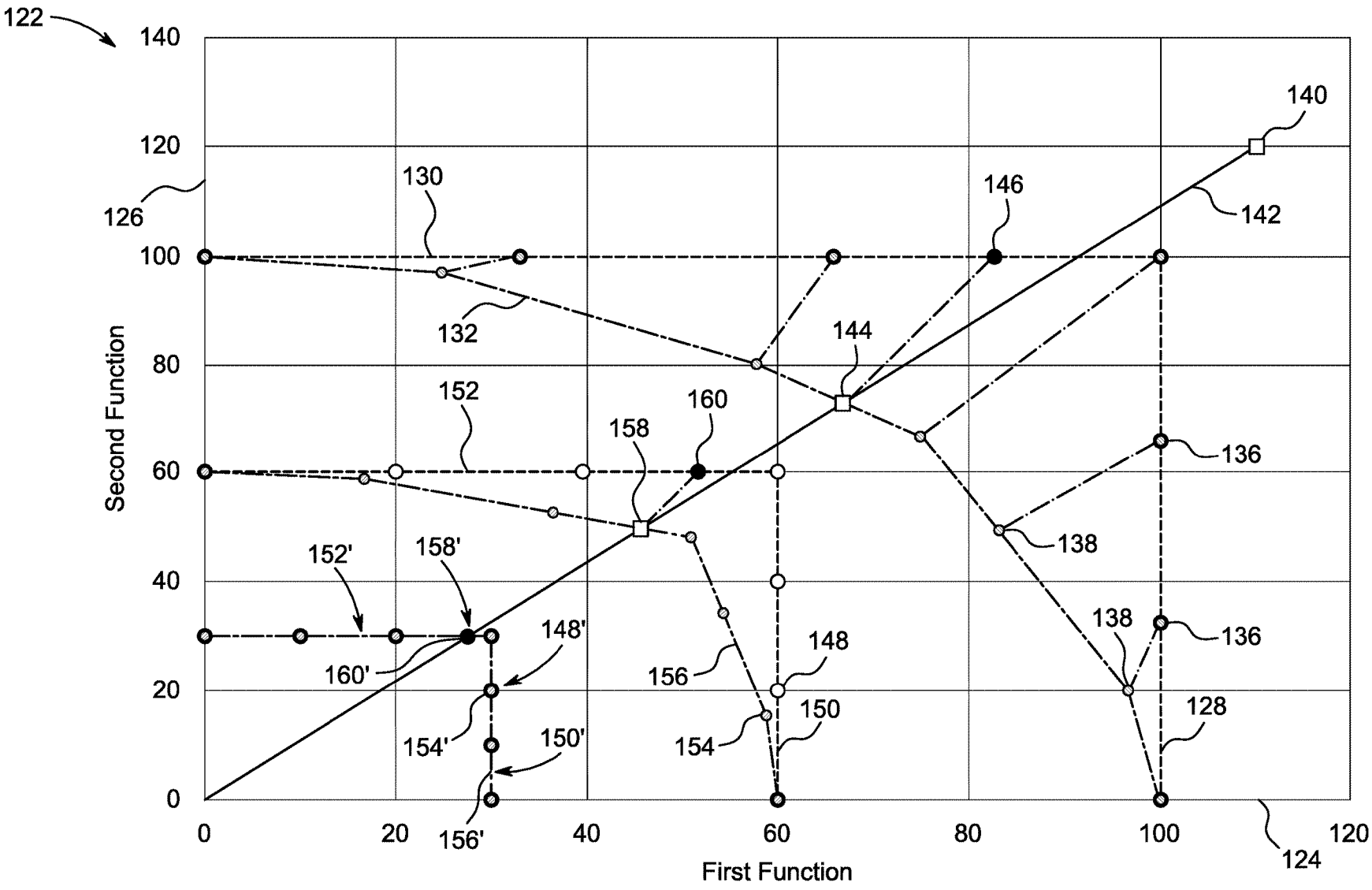
FIG. 3 is a graphical illustration of a control map according to aspects of the present disclosure.
Figure 4:
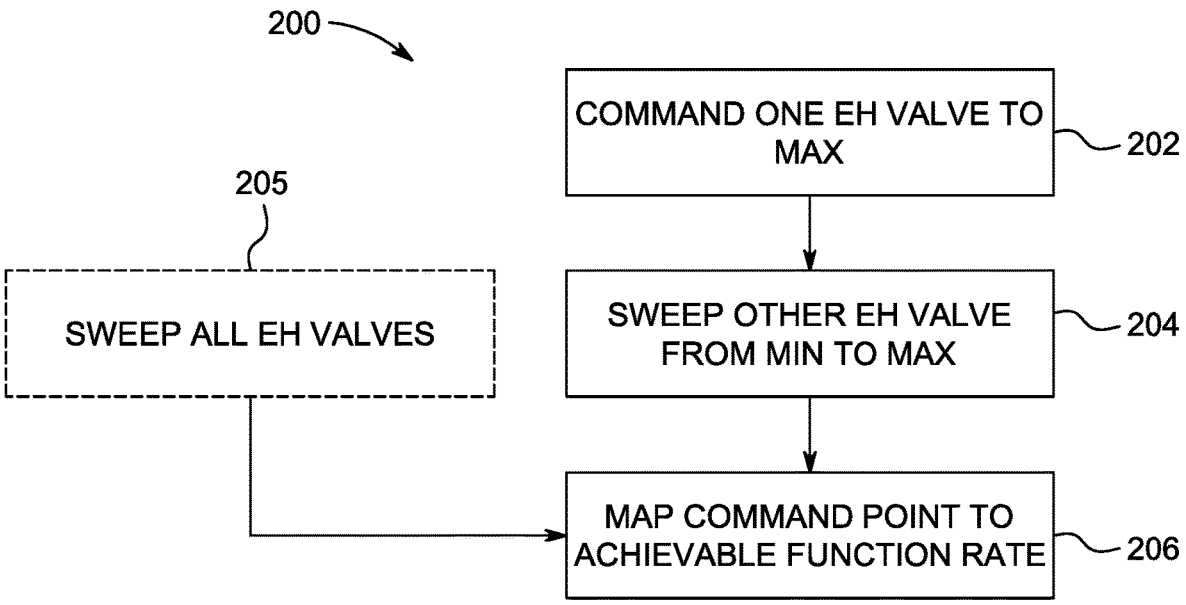
FIG. 4 is a flowchart of a method for generating the control map of FIG. 3.

The calibration process can be used to generate the control maps 122, as illustrated in FIGS. 3-4. FIG. 3 illustrates one non-limiting example of the control map 122. In the illustrated non-limiting example, an x-axis 124 of the control map 122 can represent a command of the first electrohydraulic valve 106 and a y-axis 126 can represent a command of the second electrohydraulic valve 108. For example, an electrohydraulic valve may be commanded from zero to one (or some other unitless scale), where zero represents no function command and one represents a maximum function command. In the illustrated non-limiting example, the first electrohydraulic valve 106 and the second electrohydraulic valve 108 can be commanded between 0% and 100%, where 0% can represent no function command and 100% can represent a maximum function command. In the illustrated non-limiting example, the x-axis 124 can also represent an achievable function rate of the first function 102 and the y-axis 126 can also represent an achievable function rate of the second function 104, as will be described herein. For example, a function may be able to achieve a maximum rate when the function is individually commanded and its corresponding electrohydraulic valve is commanded to 100%, thus driving the function at a maximum potential. As such, the achievable function rate can represent the fraction or ratio of the maximum potential achieved by the function during multi-function operation (e.g., the achievable function rate can be normalized with respect to the maximum potential of the functions). In one non-limiting example, the achievable function rate of the function can be from zero to one (or some other unitless scale), where zero represents no motion and one represents motion equal to the maximum potential. In the illustrated non-limiting example, the first function 102 and the second function 104 can have an achievable function rate between 0% and 100%, where 0% can represent no motion and 100% can represent motion equal to the maximum potential.

In the illustrated non-limiting example, a first function command boundary 128 and a second function command boundary 130 can be defined. The first function command boundary 128 can represent a normalized maximum rate of the first function 102 (e.g., the maximum potential described herein). Along the first function command boundary 128 can be a series of points formed by commanding the first electrohydraulic valve 106 to a maximum function command and sweeping the second electrohydraulic valve 108 from a minimum function command to a maximum function command, or vice versa. For example, the first electrohydraulic valve 106 can be given a command of 100% and the second electrohydraulic valve 108 can sweep through function commands from 0% to 100%, at some predefined interval. Alternatively, the first electrohydraulic valve 106 can be given a command of 100% and the second electrohydraulic valve 108 can sweep through function commands from 100% to 0%, at some predefined interval. In one non-limiting example, the series of points along the first function command boundary 128 can be derived by commanding the first electrohydraulic valve 106 to a maximum function command and sweeping the second electrohydraulic valve 108 up from a minimum function command to a maximum function command, and then sweeping the second electrohydraulic valve 108 down from a maximum function command to a minimum function command, at some predefined interval.

Similarly, the second function command boundary 130 can represent a normalized maximum rate of the second function 104 (e.g., the maximum potential described herein). Along the second function command boundary 130 can be a series of points formed by commanding the second electrohydraulic valve 108 to a maximum function command and the first electrohydraulic valve 106 to sweep from a minimum function command to a maximum function command, or vice versa. For example, the second electrohydraulic valve 108 can be given a command of 100% and the first electrohydraulic valve 106 can sweep through function commands from 0% to 100%, at some predefined interval. Alternatively, the second electrohydraulic valve 108 can be given a command of 100% and the first electrohydraulic valve 106 can sweep through function commands from 100% to 0%, at some predefined interval. In one non-limiting example, the series of points along the second function command boundary 130 can be derived by commanding the second electrohydraulic valve 108 to a maximum function command and sweeping the first electrohydraulic valve 106 from a minimum function command to a maximum function command, then sweeping the first electrohydraulic valve 106 down from a maximum function command to a minimum function command, at some predefined interval. In one non-limiting example, the first electrohydraulic valve 106 and the second electrohydraulic valve 108 may be held at each interval such that a quasi-steady state is achieved in the hydraulic system 100.

One of ordinary skill in the art would readily recognize a plurality of ways to define the series of points along the foregoing command boundaries. For example, the first electrohydraulic valve 106 and the second electrohydraulic valve 108 may each sweep from a minimum function command to a maximum function command, or vice versa. In another non-limiting example, the first electrohydraulic valve 106 can be held at some fixed command between the maximum command and the minimum command and the second electrohydraulic valve 108 can sweep from a minimum command to another fixed command between the maximum command and the minimum command, or vice versa.

In the illustrated non-limiting example, the control map 122 can include a maximum achievable rate boundary 132. The maximum achievable rate boundary 132 can represent the maximum achievable rate (e.g., velocity of the function extension or retraction or other form of rate previously described herein) for a given set of commands for the first electrohydraulic valve 106 and the second electrohydraulic valve 108. For example, during multi-function commands the first electrohydraulic valve 106 and the second electrohydraulic valve 108 share hydraulic flow from the pump 112, which can have a limited capacity, as such flow to one function can be reduced due to flow to another. The maximum achievable rate boundary 132 can be generated by the calibration process described below.

FIG. 4 illustrates steps for the calibration process 200 described herein. The calibration process can begin at step 202, where the controller 114 may command one of the first electrohydraulic valve 106 and the second electrohydraulic valve 108 to a maximum function command. Then at step 204, the controller 114 may sweep, at some regular or irregular predefined interval, the other of the first electrohydraulic valve 106 and the second electrohydraulic valve 108 from a minimum function command to a maximum function command, thereby defining command points 136 along one of the first function command boundary 128 and the second function command boundary 130. In one non-limiting example, each command point can be a multi-function command and include at least a maximum command for one of the first electrohydraulic valve 106 and the second electrohydraulic valve 108 and at least a partial command for the other of the first electrohydraulic valve 106 and the second electrohydraulic valve 108. In some non-limiting examples, the partial command can be that of a minimum function command, a maximum function command, or any command therebetween.

At each command point 136, the controller 114 can map the command point 136 to an achievable function rate 138 at step 206. In one non-limiting example, each achievable function rate 138 can include a first achievable rate of the first function 102 and a second achievable rate for the second function 104. The controller 114 can map the command point 136 to the achievable function rate 138 by sensing the velocity of the first function 102 and the second function 104 using, for example, the first rate sensor 113 and the second rate sensor 115 to measure the achievable rate of the first function 102 and the second function 104, respectively. In one non-limiting example, the first electrohydraulic valve 106 and the second electrohydraulic valve 108 may be held at each command point 136 such that the controller 114 can sense a quasi-steady state within the hydraulic system 100 (e.g., via the motions sensors, work port pressures, pilot pressures, etc.) prior to mapping the command point 136 to the achievable function rate 138. The controller 114 may store (e.g., in the memory 120) the sensed velocities of the first function 102 and the second function 104 for each command point 136. As such, each command point 136 can be correlated to a maximum achievable rate for the first function 102 and the second function 104 on the maximum achievable rate boundary 132. In some non-limiting examples, the controller 114 can also store other variables that can be measured or otherwise affect the hydraulic system 100—even if they do not have input commands associated with them. For example, pump pressure, work port pressure, engine load, engine speed, or machine information like mobile machine structure size or position for each command point. The controller 114 may also be configured to detect and store the dynamic response performance of the functions on the machine during the multi-function step and ramp commands previously described herein. For example, the controller 114 may analyze and store a function's characteristic dynamic response profile (e.g., transfer function), frequency response, or a discrete lag or delay in response at each of the plurality of command points 136. For example, the controller 114 may analyze the delays in rate feedback seen in each function during the commands provided in the calibration process 200. Additionally, the controller 114 may be configured to determine the frequency response of each function by performing a chirp (step) command to each function individually and determine the frequency response at which the function falls below 3 dB. The natural frequency of the machine can also be determined by observing instabilities that may occur during the multifunction step and ramp commands. The foregoing variables may all be used to affect the resultant achievable function rate 138 (e.g., limits of achievable flow may change as engine speed changes, etc.) or used later by the controller 114 to supplement control processes and algorithms, and as such can be stored in the memory 120 and linked to each command point 136.

The controller 114 may then repeat steps 202, 204, and 206, instead starting with a different electrohydraulic valve than that of the start. For example, in one non-limiting example of the calibration process 200, the controller 114 may start at step 202 and command the first electrohydraulic valve 106 to a maximum function command. Then at step 204, the controller 114 may sweep the second electrohydraulic valve 108 from a minimum function command to a maximum function command, thereby defining the command points 136 along one of the first function command boundary 128. Next, at step 206, the controller 114 can map and store the achievable function rate 138 for each command point 136. The controller 114 may be configured to return to step 202 and command the second electrohydraulic valve 108 to a maximum function command. Then, at step 204, the controller 114 may sweep the first electrohydraulic valve 106 from a minimum function command to a maximum function command, thereby defining the command points 136 along the second function command boundary 130. Finally, at step 206 the controller 114 can map and store the achievable function rate 138 for each command point 136, thereby completing the control map 122.

Alternatively, the controller 114 may start at step 205, as shown by dashed lines in FIG. 4. At step 205, the controller 114 may sweep, at some regular or irregular predefined interval, each of the first electrohydraulic valve 106 and the second electrohydraulic valve 108 from a minimum function command to a maximum function command (or vice versa), thereby defining command points 136 along one of the first function command boundary 128 and the second function command boundary 130. In one non-limiting example, each command point can be a multi-function command and include at least a partial command for each of the first electrohydraulic valve 106 and the second electrohydraulic valve 108. In some non-limiting examples, the partial command can be that of a minimum function command, a maximum function command, or any command therebetween. The controller 114 may then proceed to step 206 to map and store the achievable function rate 138 for each command point 136, thereby completing the control map 122.

With continued reference to FIGS. 3 and 4, the calibration process 200 can be repeated numerous times to generate a plurality of intermediate command boundaries and a corresponding plurality of achievable rate boundaries. In the illustrated non-limiting example, the controller 114 can return to step 202 and may command one of the first electrohydraulic valve 106 and the second electrohydraulic valve 108 to a first fixed partial function command (e.g., 30%, 60%, etc.). Then at step 204, the controller 114 may sweep, at some regular or irregular predefined interval, the other of the first electrohydraulic valve 106 and the second electrohydraulic valve 108 from a minimum function command to a second fixed partial function command, thereby defining intermediate command points 148 along one of the first function intermediate command boundary 150 and the second function intermediate command boundary 152. In the illustrated non-limiting example, the first fixed partial command and the second fixed partial command can be substantially the same (e.g., 60%). However, the first fixed partial command and the second fixed partial command may be different. For example, the first fixed partial command can be higher (e.g., 80%) than that of the second fixed partial command (e.g., 40%), or vice versa. Each intermediate command point 148 can be a multi-function command and include at least a partial or intermediate command for one of the first electrohydraulic valve 106 and the second electrohydraulic valve 108.

At each intermediate command point 148, the controller 114 can map the intermediate command point 148 to an achievable function rate 154 at step 206. In one non-limiting example, each achievable function rate 154 can include a first achievable rate of the first function 102 and a second achievable rate for the second function 104. The controller 114 can map the intermediate command point 148 to the achievable function rate 154 by sensing the velocity of the first function 102 and the second function 104 using, for example, the first rate sensor 113 and the second rate sensor 115 to measure the achievable rate of the first function 102 and the second function 104, respectively. The controller 114 may store (e.g., in the memory 120) the sensed rates of the first function 102 and the second function 104 for each intermediate command point 148. As such, each intermediate command point 148 can be correlated to a maximum achievable rate for the first function 102 and the second function 104, thereby defining an intermediate achievable rate boundary 156 corresponding to the first function intermediate command boundary 150 and the second function intermediate command boundary 152. The controller 114 may then repeat steps 202, 204, and 206, instead starting with a different electrohydraulic valve than that of the start, as previously described herein.

Alternatively, the controller 114 may start at step 205, as shown by dashed lines in FIG. 4. At step 205, the controller 114 may sweep, at some regular or irregular predefined interval, the first electrohydraulic valve 106 from a minimum function command to the first fixed partial command (or vice versa) and simultaneously sweep the second electrohydraulic valve 108 from a minimum function command to the second fixed partial command (or vice versa), thereby defining intermediate command points 148 along one of the first function intermediate command boundary 150 and the second function intermediate command boundary 152. In one non-limiting example, each command point can be a multi-function command and include at least a partial command for each of the first electrohydraulic valve 106 and the second electrohydraulic valve 108. In some non-limiting examples, the partial command can be any command between the minimum function command and one of the first fixed partial command or the second fixed partial command. The controller 114 may then proceed to step 206 to map and store the achievable function rate 154 for each intermediate command point 148.

In some cases, the hydraulic system 100 may be capable of supplying enough flow such that the intermediate command boundaries and corresponding achievable rate boundaries overlap. For example, the first function intermediate command boundary 150' and the second function intermediate command boundary 152' can be overlapped by the achievable rate boundary 156'. In this case, an achievable function rate 154' for a given intermediate command point 148' can be positioned in substantially the same location of the control map 122. In one non-limiting example, the achievable function rate 154' can reside on one of the first function intermediate command boundary 150' and the second function intermediate command boundary 152', but shifted in relation to the corresponding intermediate command point 148' (e.g., shifted left, right, up, or down from the perspective of FIG. 3). For example, for any given intermediate command point 148', the resulting achievable function rate 154' may not have a "one-to-one" relationship with the intermediate command point 148'. In one non-limiting example, a 20% command of an electrohydraulic valve may not correlate to an achievable rate that is 20% of the maximum potential for the function. In some non-limiting examples, this may be caused by electrohydraulic valve dead zones and/or saturation regions.

In one non-limiting example, the process described above with reference to generating the control map 122 can be accomplished within a computer simulation program. For example, the parameters, configuration, and/or geometric properties of the hydraulic system 100 can be put into a computer simulation. The computer simulation can then run the foregoing calibration process 200 described above in order to generate the control map 122. In this non-limiting example, the control map 122 can be an output of the computer simulation program, which may then be uploaded to the memory 120 of the controller 114. For example a computer simulation program could be used to generate the control map by simulating the plurality of electrohydraulic valve input commands by commanding one of a simulated first electrohydraulic control valve and a simulated second electrohydraulic control valve to the maximum command and commanding the other of the simulated first electrohydraulic control valve and the simulated second electrohydraulic control valve to sweep, at some regular or irregular predetermined interval, from the minimum command to the maximum command (or by using the alternative calibration methods previously described herein). The computer simulation program may then calculate a rate of a simulated first function and a rate of a simulated second function for each of the plurality of electrohydraulic valve input commands, thereby determining the plurality of achievable function rates. The computer simulation program may then map each of the plurality of achievable function rates to their corresponding electrohydraulic valve input commands for the simulated first electrohydraulic valve and the simulated second electrohydraulic valve.

In one non-limiting example, the control map 122 can be generated by continuous data collection while the mobile machine is being operated. For example, during operation of the mobile machine (e.g., manual operation, remote operation, or autonomous operation) commands are continuously being delivered to the electrohydraulic control valves. This command data can be taken during operation in a process similar to that described in FIG. 4. In this case, the controller 114 may continuously record (e.g., at discrete time intervals) command points 136 and map each command point to a sensed corresponding achievable function rate 138. In one non-limiting example, the controller 114 can wait until a quasi-steady state is reached by the rate of the function prior to recording data. When the control map 122 is generated in this matter, the control map can take the form of an array of command points 136 mapped to a corresponding array of achievable function rates. As such, the control map 122 can be formed from a random array of data points. For example, the control map 122 can be formed from a scatter of command points 136 and each of the scatter of command points 136 can be correlated to a scatter of corresponding achievable function rates 138 to form a data set of command points 136 and achievable function rates 138. In this case, the control map 122 formed by the scattered data points may not include achievable rate boundaries or function command boundaries, as the command points 136 were not commanded in a regular or structured manner, such as the process described in FIG. 4. Alternatively, in one non-limiting example, achievable rate boundaries and function command boundaries can be extrapolated from the scatter of command points 136 and the scatter of corresponding achievable function rates 138 by data analysis methods known in the art.

In the illustrated non-limiting example, the control map 122 is a two dimensional control map defining one quadrant of a full two dimensional control map. However, the control map 122 may be made to include four quadrants. For example, an electrohydraulic valve may be commanded from −1:0:1 (or some other unitless scale), where zero represents no function command and +/−1 represents a maximum function command in two different directions. In one non-limiting example, the first electrohydraulic valve 106 and the second electrohydraulic valve 108 can be commanded between −100%, 0%, and 100%, where 0% can represent no function command and +/−100% can represent a maximum function command in opposing directions. In the foregoing examples, a positive function command value (e.g., 1, 100%) can correlate to an electrohydraulic valve being commanded to move a function in a first direction (e.g., extend). Alternatively, a negative function command value (e.g., −1, −100%) can correlate to an electrohydraulic valve being commanded to move a function in a second direction (e.g., retract). As such, the control map 122 can include a first quadrant, a second quadrant, a third quadrant, and a fourth quadrant. The first quadrant may include command points 136 that correlate to the first electrohydraulic valve 106 and the second electrohydraulic valve 108 being commanded to move the first function 102 and the second function 104 in the first direction. The second quadrant may include command points 136 that correlate to the first electrohydraulic valve 106 being commanded to move the first function 102 in the first direction and the second electrohydraulic valve 108 being commanded to move the second function 104 in the second direction. The third quadrant may include command points 136 that correlate to the first electrohydraulic valve 106 and the second electrohydraulic valve 108 being commanded to move the first function 102 and the second function 104 in the second direction. The fourth quadrant may include command points 136 that correlate to the first electrohydraulic valve 106 being commanded to move the first function 102 in the second direction and the second electrohydraulic valve 108 being commanded to move the second function 104 in the first direction. Similar to the control map 122 illustrated in FIG. 3, the command points 136 in all four quadrants of a two dimensional control map can be mapped to achievable function rates 138. As such, the maximum achievable rate boundary 132 may define a two dimensional shape (e.g., substantially circular, oval, rectangular, or any other amorphous two-dimensional shape). In one non-limiting example, a two dimensional control map can be substantially symmetrical or asymmetrical across the x axis 124 and the y axis 126.

Other forms of the control map 122 may be achieved using the approach described herein. For example, a control map 122 can be that of a three dimensional control map including a first electrohydraulic valve command (along an x-axis), a second electrohydraulic valve command (along a y-axis), and a third electrohydraulic valve command (along a z-axis). As such, the maximum achievable rate boundary 132 may define a three dimensional shape or surface (e.g., substantially spherical, spheroidal, ellipsoidal, cubical, cuboidal, any amorphous three dimensional shape, etc.). Additionally, the plurality of intermediate achievable rate boundaries 156 can form a series of three dimensional surfaces enveloped by the maximum achievable rate boundary 132 (i.e., the maximum achievable rate boundary). As previously described herein, the control map 122 can be generated by a scatter of command points and achievable function rates, as such, a three dimensional control map may consist of a "cloud" of command points and corresponding achievable function rates (e.g., a three dimensional scatter of data). One of ordinary skill in the art would readily recognize that the control map 122 can be configured to contain n dimensions correlating to n number of functions or electrohydraulic valves (where n is an integer value). As such, the maximum achievable rate boundary 132 may be defined by an n-dimensional data set. Additionally, a plurality of intermediate achievable rate boundaries can form a series of n-dimensional data sets.

Figure 5:
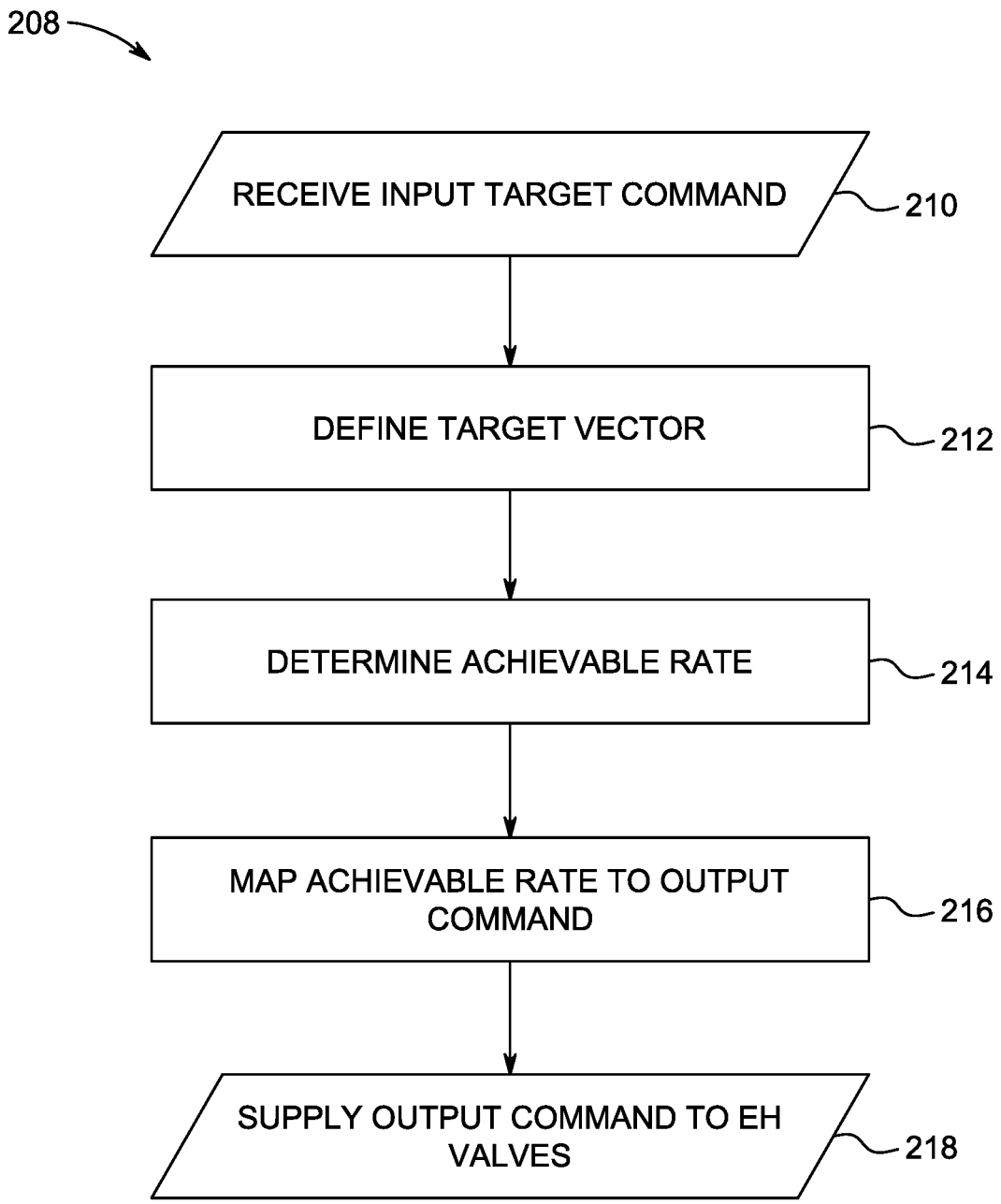
FIG. 5 is a flowchart of a method for determining output commands from input commands using the control map of FIG. 3.

With reference to FIGS. 3 and 5, the controller 114 can execute a command mapping process 208 to adjust the input commands 116 to command the first electrohydraulic valve 106 and the second electrohydraulic valve 108 based on the control map 122. In the illustrated non-limiting example, the command mapping process 208 can begin at step 210, where a target command 140 can be given as an input 116 to the controller 114. In one non-limiting example, the target command 140 can include a first target rate for the first function 102 and a second target rate for the second function 104. The controller 114 can then define a target vector 142 at step 212. In the illustrated non-limiting example, the target vector 142 can be defined as a vector starting at the origin of the control map 122 and passing through the target command 140 (see, e.g., FIG. 3).

At step 214, the controller 114 may then determine a maximum achievable rate 144 based on the input target command 140 using the control map 122. In one non-limiting example, the maximum achievable rate 144 can include a first achievable rate for the first function 102 and a second achievable rate for the second function 104. In one non-limiting example, the maximum achievable rate 144 can be determined from an intersection of the target vector 142 and the maximum achievable rate boundary 132. In one non-limiting example, the maximum achievable rate 144 can be selected from a plurality of achievable function rates 138 along the maximum achievable rate boundary 132. For example, the controller 114 may select the achievable function rate 138 that lies nearest to the target vector 142 on the control map 122. In another non-limiting example, may generate the achievable function rate 138 using, for example, interpolation techniques in the case that the target vector 142 intersects the maximum achievable rate boundary 132 between two adjacent achievable function rates 138. In any case, the maximum achievable rate 144 can lie on the target vector 142 such that the maximum achievable rate 144 is proportionally scaled from the target command 140. For example, the maximum achievable rate 144 may be selected such that a proportional relationship is maintained between a target ratio of the first target rate to the second target rate and an achievable ratio of the first achievable rate to the second achievable rate. In that way, a ratio (e.g., target ratio) of the velocities of the target command can be the same as a ratio (e.g., achievable ratio) of the selected maximum achievable rate 144.

At step 216, the controller 114 may then map the maximum achievable rate 144 to an output command 146. In one non-limiting example, the output command 146 can be a multi-function command and include a first output command for the first electrohydraulic valve 106 and a second output command for the second electrohydraulic valve 108. The output command 146 can be selected from a plurality of command points 136 along one of the first function command boundary 128 and the second function command boundary 130. For example, the controller 114 may use the control map 122 to select the output command 146 that correlates to the selected maximum achievable rate 144, where the correlation between each of the plurality of command points 136 and the achievable function rates 138 was determined during the generation of the control map 122, as described herein. The output command 146 to the first electrohydraulic valve 106 and the second electrohydraulic valve 108 can be selected by the controller 114 such that the first function 102 can move at the first achievable rate and the second function 104 can move at the second achievable rate defined by the determined maximum achievable rate 144.

At step 218, the controller 114 can supply the first function output command to the first electrohydraulic valve 106 to move the first function 102 at the first achievable rate and simultaneously supply the second function output command to the second electrohydraulic valve 108 to move the second function 104 at the second achievable rate. As such, the output command 146 results in moving the first function 102 and the second function 104 at velocities that have been proportionally scaled from the input target command 140. This form of hydraulic control can result in fast and accurate positioning of hydraulic functions that includes considerations for flow sharing between electrohydraulic valves in a hydraulic system during multi-function commands.

In the illustrated non-limiting example, the input target command 140 can be outside (e.g., greater than) the first function command boundary 128 and the second function command boundary 130. For example, the first target rate for the first function 102 and the second target rate for the second function 104 included in the input target command 140 can be greater than the maximum potential of the first function 102 and the second function 104. In this case, the maximum achievable rate boundary 132 can be used. In the illustrated non-limiting example, the controller 114 can select a maximum achievable rate 144 that lies along the target vector 142. In the case that the controller 114 determines that the target command 140 is unachievable, the controller 114 can select a maximum achievable rate 144 along the maximum achievable rate boundary 132 that intersects with the target vector 142. In any case, the controller 114 may then map the maximum achievable rate 144 to the corresponding output command 146. For example, the controller 114 may use the control map 122 to select the output command 146 that correlates to the selected maximum achievable rate 144, where the correlation between each of the plurality of command points 136 and the achievable function rates 138 was determined during the generation of the control map 122, as described herein. The output command 146 to the first electrohydraulic valve 106 and the second electrohydraulic valve 108 can be selected by the controller 114 such that the first function 102 can move at the first achievable rate and the second function 104 can move at the second achievable rate defined by the determined maximum achievable rate 144.

In other cases, the target command 140 may lie within (e.g., less than) the maximum achievable rate boundary 132. For example, the first target rate for the first function 102 and the second target rate for the second function 104 included in the input target command 140 can be less than the achievable function rates 138 on the maximum achievable rate boundary 132. In this case, the controller 114 can select an intermediate achievable rate 158 along one of the plurality of intermediate achievable rate boundaries 156 that lies along the target vector 142. In one non-limiting example, the target command 140 may lie between two of the plurality of first function intermediate command boundaries 150 and second function intermediate command boundaries 152. In this case, the controller 114 may select the nearest intermediate command boundary or interpolate data (e.g., via interpolation methods known in the art) between the intermediate command boundaries to determine an intermediate achievable rate 158 along the target vector 142. In any case, the controller 114 may then map the intermediate achievable rate 158 to an intermediate output command 160. In one non-limiting example, the intermediate output command 160 can be a multi-function command and include a first output command for the first electrohydraulic valve 106 and a second output command for the second electrohydraulic valve 108. The intermediate output command 160 can be selected from a plurality of intermediate command points 148 along one of the first function intermediate command boundary 150 and the second function intermediate command boundary 152. For example, the controller 114 may use the control map 122 to select the intermediate output command 160 that correlates to the selected intermediate achievable rate 158, where the correlation between each of the plurality of intermediate command points 148 and the achievable function rates 154 was determined during the generation of the control map 122, as described herein. The intermediate output command 160 to the first electrohydraulic valve 106 and the second electrohydraulic valve 108 can be selected by the controller 114 such that the first function 102 can move at the first achievable rate and the second function 104 can move at the second achievable rate defined by the determined intermediate achievable rate 158.

In one non-limiting example, the target command 140 can be lie on the control map 122 with the scatter of a plurality of command points with corresponding achievable function rates (either a maximum achievable function rates 138 or intermediate achievable function rates 154, 154'). In this case, the controller 114 can select the achievable rate (either a maximum achievable rate 144 or an intermediate achievable rate 158, 158') among the plurality of achievable function rates that lie on or near the target vector 142. In one non-limiting example, the controller 114 may select the nearest of the plurality of achievable function rates or interpolate data (e.g., via interpolation methods known in the art) between two or more of the plurality of achievable function rates along the target vector 142.

One of ordinary skill in the art would recognize that the functions may only require rate sensors during the calibration process 200. The command mapping process 208 described with reference to FIG. 5 could be done in an "open-loop" configuration. For example, before the calibration process 200, the rate sensors may be installed on the mobile machine, then the calibration process 200 could be carried out to define the control map 122 specific to that mobile machine or function configuration. The rate sensors could then be removed and the controller 114 may then process target commands 140 in the open-loop configuration, where the controller manipulates the target commands to output commands 146 based on the predefined achievable rates found during the calibration process 200 without receiving feedback signals from the rate sensors.

It is to be understood that the foregoing steps described with reference to FIG. 5 may illustrate a single command cycle. In one non-limiting example, the controller 114 can be configured to continuously perform the command mapping process 208, thereby executing a series of command cycles. These command cycles can be executed by the controller 114 at regular intervals. For example, the controller 114 can be configured to execute the command cycle at timed intervals. Target commands 140 input to the controller 114 can continuously change during operation of the mobile machine. In one specific non-limiting example, in the case of an excavator, the boom, arm, and bucket can be extended out and away from the cab, lowered to the ground, then retracted back in towards the cab to, for example, dig a trench. This operation generally includes three or more functions with continuously changing target commands. For example, if the mobile machine is under manual control, an operator in the cab of the mobile machine may be continuously changing the control stick position to execute the operation described above, thereby continuously providing new inputs 116 to the controller 114. As such, the controller 114 is continuously receiving a varying set of target commands 140 for the multifunction operation of the mobile machine and can be configured to execute the command cycle continuously at regular or irregular predefined intervals or in response to a change in the target command 140. The command cycle described herein with reference to FIG. 5 may also be supplemented with additional steps such that the controller 114 can provide accurate function rates and function positioning when transitioning between two different target commands (e.g., controlling the transient state of the system), as will be described below.

Figure 6:
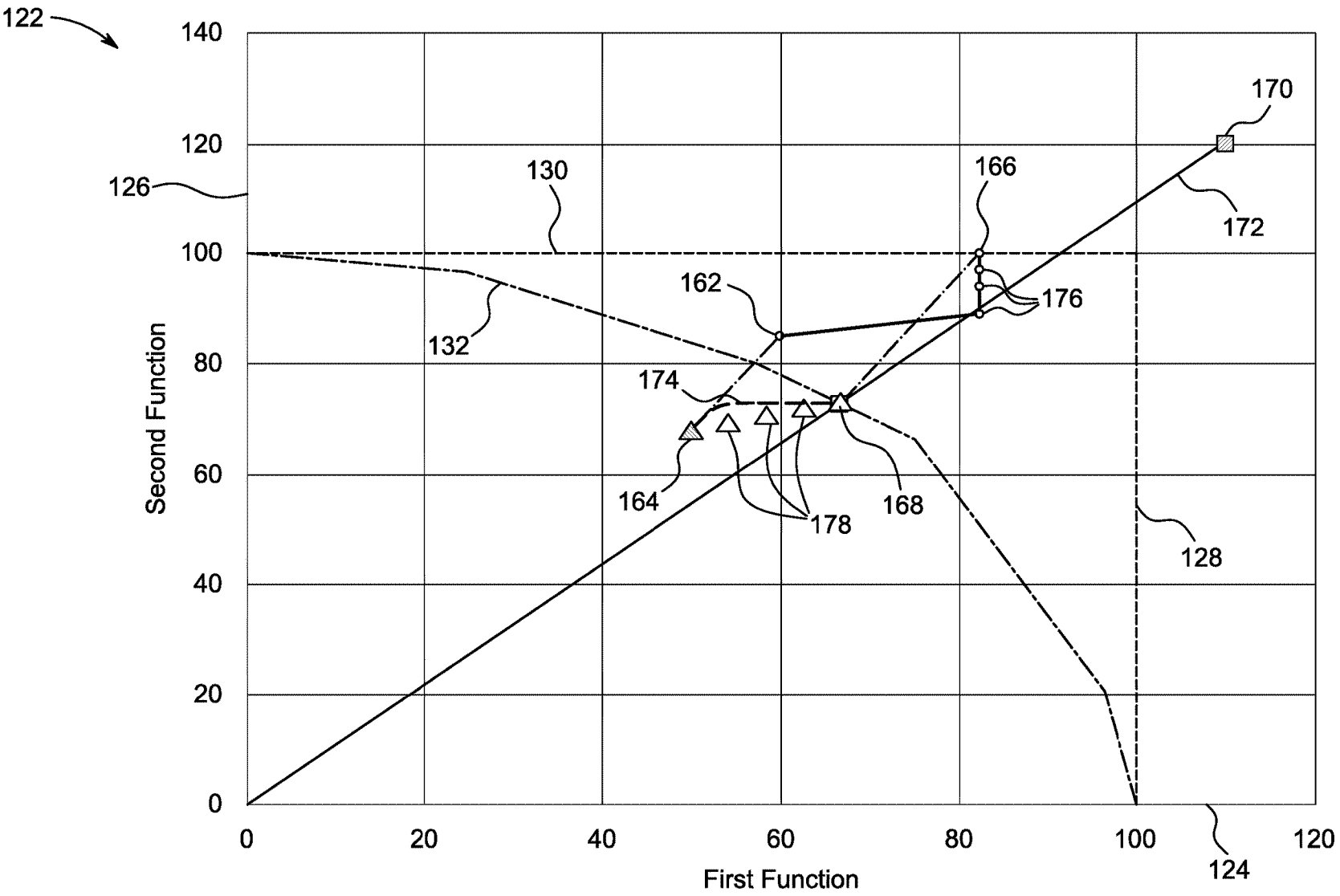
FIG. 6 is a graphical illustration of the control map of FIG. 3 depicting a transient command shaping process according the aspects of the present disclosure.
Figure 7:
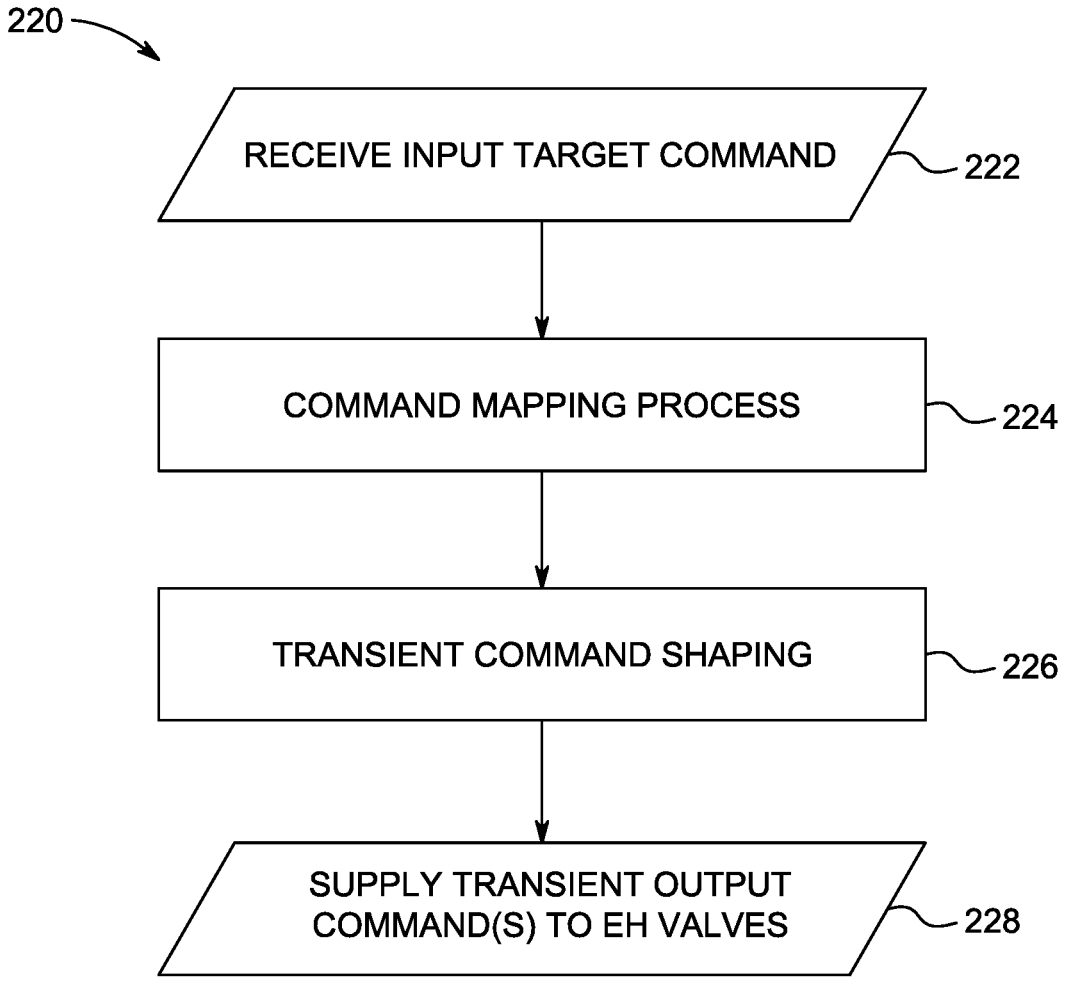
FIG. 7 is a flowchart of a method for determining transient commands from input commands using the control map of FIG. 6.
Figure 8:
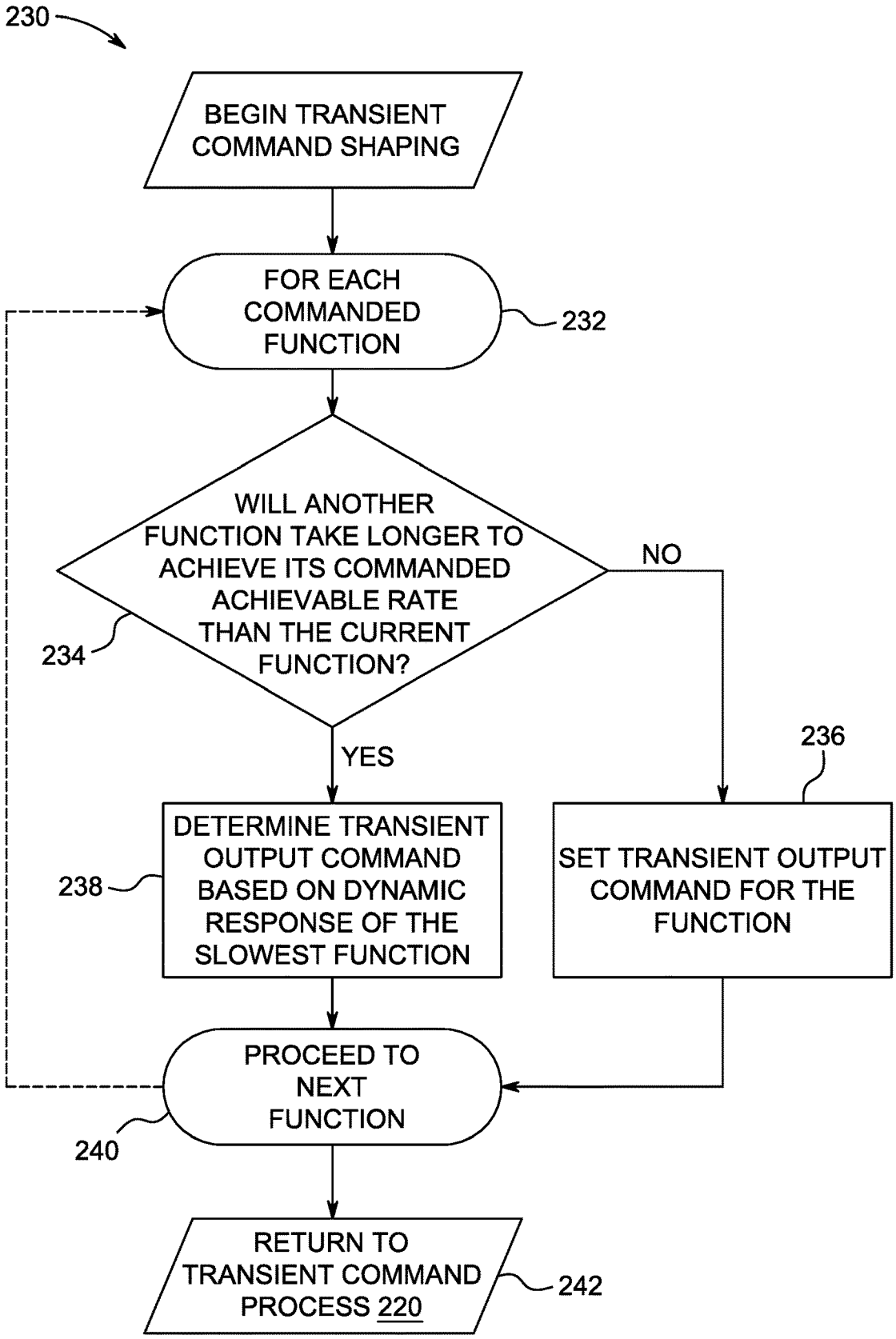
FIG. 8 is a flow chart of the transient command shaping process of altering output commands based on a dynamic response of the functions.

With reference to FIGS. 6 through 8, the controller 114 can execute a transient command process 220 to adjust commands to the first electrohydraulic valve 106 and the second electrohydraulic valve 108 based on the control map 122 and the transient or dynamic response performance of the electrohydraulic valves and/or the hydraulic functions when the electrohydraulic valves and the hydraulic functions are transitioning from one achievable rate to another. FIG. 6 illustrates one non-limiting example of the control map 122 of FIG. 3 with one such transient command process illustrated thereon. Although not explicitly illustrated in FIG. 6, it is to be understood that each aspect of the control map 122 described with reference to FIG. 3 can also exist on the control map 122 illustrated in FIG. 6. The illustrated non-limiting example of the control map 122 of FIG. 6 has been simplified to better illustrate the transient command process described in the following paragraphs. For example, the first function command boundary 128 and the second function command boundary 130 can include one or more command points (not shown). In addition, the maximum achievable rate boundary 132 may include of one or more achievable function rates (not shown). As previously described herein, the control map 122 can include numerous intermediate command boundaries (not shown) and intermediate achievable rate boundaries (not shown).

In the illustrated non-limiting example, the controller 114 can execute a series of steps to transition from a first output command 162 (e.g., a previous output command) with a corresponding first achievable rate 164 to a second output command 166 (e.g., a new output command) with a corresponding second achievable rate 168. With reference to FIGS. 6 and 7, the transient command process 220 can begin at step 222 where the controller 114 receives a new input target command 170. The controller 114 may then perform the command mapping process 208 described herein with reference to FIG. 5. For example, once the new target command 170 is received (i.e., step 210 of FIG. 5), the controller 114 may then define a new target vector 172 based on the target command 170 (i.e., step 212 of FIG. 5). The controller 114 may then, using the control map 122, determine a new achievable rate (e.g., the second achievable rate 168) based on the new target vector 172 (i.e., step 214 of FIG. 5). Next, the controller 114 can map the new achievable rate to a new output command (e.g., the second output command 166) using the control map 122 (i.e., step 216 of FIG. 5). The controller 114 may then execute a transient command shaping algorithm at step 226 to reduce or eliminate errors in the mobile machine function performance. In one non-limiting example, the errors in mobile machine performance can be caused by at least one of the functions responding slower than other functions. For example, the slower responding function can cause errors in the machine component travel path, as previously described herein. This can cause the functions or components of the mobile machine to be in an unexpected or undesired position for the next command cycle. In one non-limiting example, it may take several command cycles for the first function to increase its rate from the first achievable rate 164 to the second achievable rate 168, but fewer command cycles for the second function to increase its rate from the first achievable rate 164 to the second achievable rate 168. The transient command shaping algorithm will be described in detail in the following paragraphs.

FIG. 8 illustrates the transient command shaping algorithm 230, which can be configured to modify the transient response performance and compensate for a discrete delay seen in the overall system response. For example, the transient command shaping algorithm may reshape output command(s) to each electrohydraulic valve relative to the slowest responding function during multifunction commands, as will be described herein. Hydraulic functions may have different transient responses to changes in electrohydraulic valve commands. Transient responses of hydraulic functions can have various characteristics or combination of characteristics. In one non-limiting example, there may be a lag or delay from the time an electrohydraulic valve receives the output command from the controller 114 until a change in the achievable rate of the function(s) is experienced. For example, the delay can be caused by the time it takes for the electrohydraulic valve to transition from one command to the next (e.g., the time for a spool to move from one spool position to another spool position). In another non-limiting example, the delay can be caused by the time it takes for one function to accelerate/decelerate from one achievable rate to the next. For example, each function within a hydraulic system can define a characteristic dynamic response profile, as such the dynamic response performance of one function can be more sensitive to commands or respond faster than another function. In any case, the delay can be further altered by flow sharing between functions during multifunction commands. In one non-limiting example, there may be a function not under control of the controller 114 (e.g., a function only under direct pilot joystick control or manual control). In this case, the controller 114 may be configured to sense the input command to the manual function, and be able to evaluate the transient characteristics of the manual function, but may not be configured to modify or alter the manual function command using the methods described with reference to FIG. 5. As such, the controller 114 may be configured to modify the output commands to the electrohydraulic valves of the functions under control of the controller 114 to account for the dynamic response of the manual function, especially when the manual function is the slowest responding function.

In one non-limiting example, there may be a limit in how fast a function is able to transition from one achievable rate (e.g., the first achievable rate 164) to another achievable rate (e.g., the second achievable rate 168) when the target command changes from a previous target command (not shown) to a new target command 170. In one non-limiting example, a function may have a smaller change in command than the other function(s). For example, the new target command 170 can result in a new output command (e.g., the second output command 166), however the new command point may represent, in this specific non-limiting example, an approximately 22% increase in output command to the first electrohydraulic valve 106 and an approximately 15% increase in output command to the second electrohydraulic valve 108. As such, the second electrohydraulic valve 108 may achieve its output command (e.g., may reach the second output command 166) sooner.

The transient response can result in an undesirable achievable rate path 174 from the first achievable rate 164 to the second achievable rate 168 (see FIG. 6). For example, without applying the transient command shaping algorithm 230, the first function 102 and the second function 104 can respond with unexpected or undesirable function rates that can lead to overall errors in the function performance of the mobile machine. As such, the controller 114 can be configured to execute the transient command shaping algorithm 230 after the command mapping process 208 is performed to avoid this undesirable achievable rate path 174.

With continued reference to FIGS. 6 and 8, the transient command shaping algorithm 230 can begin at step 232 with the first function to be commanded (e.g., the first function 102). In the illustrated non-limiting example, the controller 114 may then proceed to step 234 to determine if there is another commanded function that will be slower to respond, or reach, the second achievable rate 168 from the first achievable rate 164. This may be due to a slow transient response characteristic of the function or the electrohydraulic valve or a large difference between the first output command 162 and the second output command 166, as previously described herein. For example, the controller 114 may evaluate the transient characteristics of the first function 102 and the second function 104 based on the data stored in the memory 120 of the controller. As previously described, for each of the plurality of command points 136, the controller 114 can detect and store the characteristic dynamic response profile, frequency response, or a discrete lag or delay in response for the first function 102 and the second function 104. In a specific non-limiting example, if the controller 114 determines that the first function 102 is the slowest responding function (e.g., if none of the other functions have a slower response), the controller 114 may proceed to step 236 and determine an appropriate transient output command 176 for the first electrohydraulic valve 106. In one non-limiting example, the controller 114 can set the transient output command 176 to the first electrohydraulic valve 106 to be equal to the second output command 166 (e.g., equal to the portion of the second output command 166 corresponding to the first electrohydraulic valve 106). In the case of the illustrated non-limiting example, the controller 114 can set the transient output command 176 to the first function 102 to approximately 85% and the second output command 166 to the first function may also be approximately 85%. In one non-limiting example, the transient output command to the slowest responding function may be a modified output command that can be that of an over command or an under command (with reference to the second output command 166) to provide an increase in the response performance of the slowest responding function. For example, if the change from the first achievable rate 164 to the second achievable rate 168 is positive (from the perspective of the present function being evaluated, in this case, the first function 102), an over command may reduce the time required for the function to realize second achievable rate 168. Likewise, if the change from the first achievable rate 164 to the second achievable rate 168 is negative (from the perspective of the present function being evaluated), an under command may reduce the time required for the function to realize the second achievable rate 168. The controller 114 may then store (e.g., in the memory 120) the determined transient output command for the first electrohydraulic valve 106 at step 240 and then return to step 232 to evaluate the next function (e.g., the second function 104).

Returning to step 234, if the controller 114 determines that the first function 102 is not the slowest responding function out of the commanded functions (e.g., if the first function 102 will respond faster than the second function 104), the controller 114 may proceed to step 238 to determine the appropriate transient output command 176 to the first electrohydraulic valve 106 and the second electrohydraulic valve 108. The determined transient output command 176 can be based on the dynamic response of the slowest responding function. In one non-limiting example, the transient output command 176 can be a portion of the difference between the previous output command (e.g., the first output command 162) and the new output command (e.g., the second output command 166). For example, the transient output command 176 to the faster of the first function 102 or the second function 104 can be configured to provide a relative decrease in the response performance of the faster responding function relative to the new output command (e.g., the second output command 166). In one non-limiting example, the controller 114 can define a ratio of the dynamic response of the current function being evaluated to the dynamic response of the slowest responding function, thereby calculating the portion of the difference between the previous output command and the new output command to deliver to the faster responding function. This dynamic response ratio, in one non-limiting example, can be calculated by evaluating the characteristic dynamic response profile of the slower responding function at the output command of the faster responding function. Based on this calculation, the controller 114 may determine the transient output command 176 to the faster responding function to provide a substantially matched response performance of the first function 102 and the second function 104. Additionally, the controller 114 may optionally re-evaluate the dynamic response of the faster function at the determined transient output command 176 to determine if an adjustment is required to the transient output command 176. For example, the transient output command to the faster responding function may be modified by over commanding or an under commanding (with reference to the transient output command 176) to provide a substantially matched response performance of the first function 102 and the second function 104.

The controller 114 may then store the determined transient output command 176 for the first function 102 at step 240 and then return to step 232 to evaluate the next function (e.g., the second function 104). The parameters used in transient command shaping may be adjusted based on flow sharing characteristics during multifunction commands and natural frequencies seen in the overall system, which can be determined by the controller 114 during the calibration process 200 previously described herein. This transient command shaping algorithm 230 can be executed by the controller 114 for each of the commanded functions. For example, the controller may execute steps 232 to 240 for both the first function 102 and the second function 104. In one non-limiting example, the hydraulic system may include more than two hydraulic functions and the controller 114 may execute steps 232 to 240 for each of the hydraulic functions. At step 242 the controller 114 may return the stored set of transient output commands for all commanded functions to step 226 of the transient command process 220 (see FIG. 7).

Returning now to FIGS. 6 and 7, at step 228 the controller 114 can supply the transient output commands 176 determined by the controller 114 during the transient command shaping algorithm 230, including the first transient output command to the first electrohydraulic valve 106 and the second transient output command to the second electrohydraulic valve 108. In one non-limiting example, the controller 114 can be configured to determine a series of transient output commands 176 to provide incremental changes in commands to the electrohydraulic valves. The series of transient output commands 176 can be configured to provide an expected achievable rate path 178 such that accurate positioning and control of the functions can be maintained when the first function 102 and the second function 104 are transitioning from the first achievable rate 164 to the second achievable rate 168.

As such, an appropriate series of transient output commands (i.e., a transient output command profile) may be generated using the command mapping methods described herein and may be further based on dynamic function response performance and hydraulic flow sharing during multifunction commands. The series of transient output commands can be configured to provide fast, accurate, and stable point-to-point motions in each function. The resulting control strategy may be implemented on hydraulic systems including two or more functions of a mobile machine (e.g., an excavator). As previously described, the control strategy of the present disclosure may provide a control method (e.g., transient command mapping) that eliminates a delayed response in the electrohydraulic valves and hydraulic functions that may be apparent in conventional closed loop rate control on a mobile machine. Each function (e.g., a cylinder or actuator) on a mobile machine can cause a discrete delay in response to a given command, which a standard PID feedback loop cannot correct. The discrete delay can be due to the flow and pressure build-up characteristics that the can be inherent to the mobile machine. Depending on the flow characteristics and kinematics of the machine, each function can respond at different rates given identical input commands at the same moment in time. These delays in response may be most apparent when the hydraulic functions are transitioning from a static state to a dynamic state.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A method of controlling one or more functions in a hydraulic system, the method comprising:

receiving an input target command including a first target rate of a first function and a second target rate of a second function;

determining an achievable rate based on the input target command, wherein the achievable rate includes a first achievable rate of the first function and a second achievable rate of the second function that are selected from a plurality of achievable function rates to maintain a proportional relationship between a target ratio of the first target rate to the second target rate and an achievable ratio of the first achievable rate to the second achievable rate;

mapping the achievable rate to an output command based on a predetermined relationship between the achievable rate and the output command, wherein the output command includes a first output command and a second output command; and supplying the first output command to a first electrohydraulic control valve in communication with the first function, and supplying the second output command to a second electrohydraulic control valve in communication with the second function.

2. The method of claim 1, wherein the method further comprises providing a controller, the controller comprising a processor and memory.

3. The method of claim 1, wherein the method further comprises:

determining which of the first function and the second function define a slower dynamic response performance; and upon determining that the first function defines the slower dynamic response performance, supplying the first output command to the first electrohydraulic control valve and supplying a transient command to the second electrohydraulic control valve, wherein the transient command is configured to decrease a dynamic response performance of the second function relative to the second output command, or upon determining that the first function defines the slower dynamic response performance, supplying a modified output command to the first electrohydraulic control valve and supplying the second output command to the second electrohydraulic control valve, wherein the modified output command is configured to increase a dynamic response performance of the first function, or upon determining that the first function defines the slower dynamic response performance, supplying the modified output command to the first electrohydraulic control valve and supplying the transient command to the second electrohydraulic control valve.

4. The method of claim 1, wherein the method further comprises generating a control map, wherein the control map includes the plurality of achievable function rates and a plurality of electrohydraulic valve input commands.

5. The method of claim 4, wherein the method further comprises defining a target vector on the control map based on the input target command, the achievable rate intersecting the target vector and maintaining the proportional relationship between the target ratio and the achievable ratio.

6. The method of claim 4, wherein generating the control map comprises:

defining the plurality of electrohydraulic valve input commands by commanding the first electrohydraulic control valve to a maximum command and commanding the second electrohydraulic control valve to sweep at a predetermined interval from a minimum command to the maximum command, or defining the plurality of electrohydraulic valve input commands by commanding each of the first electrohydraulic control valve and the second electrohydraulic control valve to sweep at the predetermined interval from the minimum command to the maximum command, or defining the plurality of electrohydraulic valve input commands by commanding the first electrohydraulic control valve to a first fixed partial command and commanding the second electrohydraulic control valve to sweep at the predetermined interval from the minimum command to a second fixed partial command, or defining the plurality of electrohydraulic valve input commands sensed during continuous operation of the hydraulic system;

sensing a rate of the first function and a rate of the second function for each of the plurality of electrohydraulic valve input commands, defining the plurality of achievable function rates; and mapping each of the plurality of achievable function rates to a corresponding electrohydraulic valve input command for the first electrohydraulic control valve and the second electrohydraulic control valve.

7. The method of claim 4, wherein generating the control map comprises:

simulating the plurality of electrohydraulic valve input commands by commanding a simulated first electrohydraulic control valve in fluid communication with a simulated first function and a simulated second electrohydraulic control valve in fluid communication with a simulated second function;

calculating a rate of the simulated first function and the simulated second function for each of the plurality of electrohydraulic valve input commands, thereby defining the plurality of achievable function rates; and mapping each of the plurality of achievable function rates to a corresponding electrohydraulic valve input command for the simulated first electrohydraulic control valve and the simulated second electrohydraulic control valve.

8. A method of controlling one or more functions in a hydraulic system, the method comprising:

receiving an input target command including a first target rate of a first function and a second target rate of a second function;

correlating the first target rate with a first output command to a first electrohydraulic control valve in fluid communication with the first function and correlating the second target rate with a second output command to a second electrohydraulic control valve in fluid communication with the second function, the first and second output commands being derived from a predefined data set mapping the input target commands to output commands based on an achievable performance of the first function and the second function;

determining a dynamic response of the first function and a dynamic response of the second function based on the first and second output commands; and upon determining that the dynamic response of the first function defines a different dynamic response relative to the dynamic response of the second function, supplying a first modified command to the first electrohydraulic control valve and supplying a second modified command to the second electrohydraulic control valve, wherein the first modified command and the second modified command are configured to, respectively, alter a response performance of the first function relative to the first output command and the second function relative to the second output command to reduce an error in controlling a rate of the first function and the second function.

9. The method of claim 8, wherein when the dynamic response of the first function is faster than the dynamic response of the second function, setting the first modified command as an under command configured to decrease the response performance of the first function relative to the first output command.

10. The method of claim 9, wherein the under command is a portion of a difference between a previous output command to the first electrohydraulic control valve and the first output command.

11. The method of claim 8, wherein when the dynamic response of the first function is slower than the dynamic response of the second function, setting the first modified command as an over command configured to increase the response performance of the first function relative to the first output command.

12. The method of claim 8, wherein when the dynamic response of the first function is slower than the dynamic response of the second function, setting the first modified command as an over command configured to increase the response performance of the first function relative to the first output command, and setting the second modified command as an under command configured to decrease the response performance of the second function relative to the second output command.

13. The method of claim 8, wherein mapping the input target commands to the output commands comprises:

determining the achievable performance based on the input target command, wherein the achievable performance includes a first achievable rate of the first function and a second achievable rate of the second function that are selected from a plurality of achievable function rates to maintain a proportional relationship between a target ratio of the first target rate to the second target rate and an achievable ratio of the first achievable rate to the second achievable rate; and mapping the achievable performance to the output command based on the predefined data set.

14. The method of claim 13, wherein the predefined data set is generated by commanding the first electrohydraulic control valve and the second electrohydraulic control valve through a plurality of electrohydraulic valve input commands;

defining the plurality of achievable function rates by sensing a rate of the first function and a rate of the second function for each of the plurality of electrohydraulic valve input commands; and correlating each of the plurality of achievable function rates to each of the plurality of electrohydraulic valve input commands.

15. The method of claim 13, wherein the proportional relationship between the target ratio and the achievable ratio is maintained by defining a target vector based on the input target command and selecting the achievable performance among the plurality of achievable function rates that intersects the target vector.

* * * * *